US006305280B1

(12) United States Patent
Beckers

(10) Patent No.: US 6,305,280 B1
(45) Date of Patent: Oct. 23, 2001

(54) CALENDER FOR MATERIAL WEBS AND METHOD FOR CALENDERING MATERIAL WEBS

(75) Inventor: Ralf Beckers, Kempen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/353,630

(22) Filed: Jul. 15, 1999

(30) Foreign Application Priority Data

Jul. 16, 1998 (DE) ..... 198 32 067

(51) Int. Cl.[7] ..... D21G 1/00; B30B 3/04
(52) U.S. Cl. ..... 100/331; 100/162 B; 100/163 A
(58) Field of Search ..... 100/161–167, 100/331

(56) References Cited

U.S. PATENT DOCUMENTS 4,319,522 3/1982 Marchioro et al. .
5,662,037 * 9/1997 Van Haag ..... 100/162 B X
5,755,156 * 5/1998 Stein et al. ..... 100/162 B
5,791,242 * 8/1998 Kayser et al. ..... 100/162 B
5,911,174 6/1999 Cramer et al. .
5,947,017 9/1999 Hartwich et al. .

FOREIGN PATENT DOCUMENTS 3004913 8/1981 (DE) .
19633671 3/1998 (DE) .
822289 2/1998 (EP) .
2049516 12/1980 (GB) .

* cited by examiner

*Primary Examiner*—Stephen F. Gerrity
(74) *Attorney, Agent, or Firm*—Greenblum & Bernstein, P.L.C.

(57) ABSTRACT

Calender for a material web, and a method for calendaring the material web. The calender includes a frame upon which at least one roll stack is mounted. The roll stack includes a plurality of rolls, in which the end rolls are designed as sag compensation rolls. An intermediate roll adjacent to one sag compensation roll is fixedly mounted to the frame. An adjusting device adjusts the sag compensation roll to control a compressive stress in a first nip, in such a manner that the compressive stress in the first nip is adjusted independently of a compressive stress in a following nip.

29 Claims, 2 Drawing Sheets

CALENDER FOR MATERIAL WEBS AND METHOD FOR CALENDERING MATERIAL WEBS

CROSS-REFERENCE TO RELATED APPLICATIONS

The present application claims priority under 35 U.S.C. §119 of German Application No. 198 32 067.1, filed on Jul. 16, 1998, the disclosure of which is expressly incorporated by reference herein in its entirety.

BACKGROUND OF THE INVENTION

1. Field of the Invention

The present invention pertains to a calender for use with a material web, such as, for example, a paper web or similar material, in which a frame holds at least one roll stack having a plurality of rolls, and in which an end roll is designed as a sag compensation roll having a jacket supported on a non-rotatably held bracket by a sag compensation device.

2. Discussion of Background Information

A calender for use with material webs is disclosed, for example, in German Patent DE 196 33 671 A1. A calender of this patent has two roll stacks, in which each roll stack has five rolls. The rolls are arranged one above the other in a common vertical plane and passed through one after another by a material web, such as, for example, a paper web. An upper roll is stationarily attached to a frame, while a lower roll is attached to a slide that is displaced by a hydraulic cylinder in a direction of the roll stack when subjected to a load. Each jacket of an associated sag compensation roll, of a plurality of sag compensation rolls, is mounted at its end on an associated bracket. The brackets are held on the roll frame (or on the slide) in a stationary manner.

However, any change in the load results in a change in a compressive stress in all the nips of the roll stack.

SUMMARY OF THE INVENTION

Accordingly, an object of the present invention is to develop a calender for use with a material web that offers improved processing capabilities, so that, for example, a change in the load will not result in a change in a compressive stress in the nips of the roll stack.

The object of the present invention is achieved by fixedly mounting an intermediate roll, adjacent to an upper sag compensation roll, on a frame of the calender. The upper sag compensation roll permits a compressive stress in an upper nip to be independently adjusted with respect to any compressive stress in any nips located below the upper sag compensation roll.

By such a design, two regions in the roll stack are created. A compressive stress in a first region (e.g., an upper nip) may be adjusted independently from a compressive stress in a second region (e.g., a remaining nip). Thus, it is possible to operate the calender with a maximum compressive stress in the upper nip, which results in a significant improvement in a glazing of the material web, particularly when the web is introduced through the first nip.

According to the disclosed calender of the present invention, the stack has five rolls. However, it is understood that the stack may include a different number of rolls, such as, for example, eight rolls, without departing from the spirit and/or scope of the invention.

According to a feature of the invention, two end rolls are of the jacketed lift type. Brackets associated with the two end rolls are fixedly mounted to the frame of the calender. As a result, a load is equally applied to the roll stack from both ends. Additionally, the present invention requires only one spare roll for both end rolls.

A typical sag compensation roll of the jacketed lift type is disclosed in, for example, German Patent DE 30 04 913 C2. In the present invention, the sag compensation roll comprises an upper roll and a lower roll of a roll stack. When the calender is operated, the jacket of one end roll is moved until it reaches a stop, such that the position of the jacket is fixed relative to the frame.

Intermediate rolls located below an upper intermediate roll are mounted on levers, and pivot about frame-stationary pivot axes. The intermediate rolls follow a change in load by the lower sag compensation roll. In addition, the nips located below the upper nip automatically open when the lower sag compensation roll is lowered.

Two similar roll stacks are arranged one after another in the disclosed invention. The two roll stacks are arranged in a direction of a web travel, such that the upper intermediate roll of the first roll stack comes into contact with one side of the material web and the upper intermediate roll of the second roll stack comes into contact with a second side of the material web. This allows the paper web to be processed in such a way that roughly the same processing results appear on both sides of the material web. Further, when the similar roll stacks have end rolls of the jacketed lift type, only one spare roll is required for both stacks.

According to an object of the invention, a calender for use with a material web comprises a frame, at least two roll stacks, and an adjusting device. Each roll stack of the at least two roll stacks has a plurality of rolls, end rolls of the plurality of rolls forming sag compensation rolls with a jacket. The sag compensation rolls are supported on a bracket that is afixed to the frame. It is noted that the bracket of the disclosed invention is non-movable. An intermediate roll, fixedly mounted to the frame, is positioned adjacent one of the sag compensation rolls. The adjusting device adjusts a sag compensation roll in order to adjust a compressive stress in a first nip, such that the compressive stress in the first nip is adjusted independently from a compressive stress adjustment of a second nip.

According to a feature of the invention, the end rolls comprise jacketed lift type rolls that are fixedly mounted to the frame by the bracket.

Another feature of the invention is that the intermediate roll is located below an upper intermediate roll that is attached to a pivotally mounted lever.

An advantage of the invention is that the at least two roll stacks are arranged one after another in a direction of travel of the material web, such that an intermediate roll of a first roll stack comes into contact with one side of the material web, while an immediate roll of a second roll stack comes into contact with an other side of the material web.

According to another object of the invention, a calender is disclosed for use with a material web, in which the calender has at least one roll stack with at least four rolls, end rolls of the at least one roll stack being designed as sag compensation rolls with a jacket non-rotatably supported on a bracket. The calender additionally comprises an intermediate roll that is positioned proximate an upper sag compensation roll, and an adjusting device that adjusts a compressive stress in an upper nip independently of a compressive stress in a remaining nip.

A still further object of the invention concerns a calender for use with a material web, in which the calender comprises a roll stack, and an adjusting device. The roll stack comprises an upper roll, a lower roll, and at least one intermediate roll. An upper nip is formed between the upper roll and the intermediate roll. A second nip is formed between the lower roll and the intermediate roll. The adjusting device adjusts a compressive stress in the first nip independently from a compressive stress adjustment of the second nip.

In an advantage of the current invention, the at least one intermediate roll comprises a plurality of intermediate rolls, with additional nips being formed by the plurality of intermediate rolls. The compressive stress in the upper nip is adjusted independently from a compressive stress adjustment of the additional nips. The compressive stress in the upper nip is adjusted independently from a compressive stress adjustment of said lower nip and said additional nips.

According to another advantage of the invention, at least one of the upper roll and the lower roll comprises a sag compensation roll. The sag compensation roll may comprise a jacketed lift type sag compensation roll.

In a still further advantage of the invention, the calendar comprises a frame, and a mounting device that fixedly mounts the intermediate roll to the frame. Alternatively, a lever pivotally mounts the intermediate roll about a frame-fixed pivot axis.

Another object of the invention concerns a calender for use with a material web. The calender has an upper roll stack, a lower roll stack, and an adjusting device. Each roll stack comprises an upper roll, a lower roll, and a plurality of intermediate rolls. An upper nip is formed between the upper roll and one intermediate roll. Remaining nips are formed between the plurality of intermediate rolls, including one intermediate roll and the lower roll of the upper roll stack. The adjusting device functions to adjust a magnitude of a load in at least one upper nip independently of a magnitude of another load in the remaining nips.

According to a feature of the invention, an open nip, of a predetermined distance, is formed between the lower roll of the upper roll stack and the upper roll of the lower roll stack. The distance of the open nip is adjustable.

In another feature of the invention, the upper roll stack and the lower roll stack are arranged one after another in a direction of travel of the material web, such that a predetermined roll of the plurality of intermediate rolls of the first roll stack comes into contact with a first side of the material web, while a predetermined roll of the plurality of intermediate rolls of the second roll stack comes into contact with a second side of the material web.

According to another object of the invention, a method is disclosed for processing a material web, by passing the material web through a first roll stack, in which the first roll stack has an upper roll, a lower roll and at least one intermediate roll that are arranged to form an upper nip between the upper roll and the intermediate roll and a remaining nip between the lower roll and the intermediate roll. Then, a compressive stress in the first nip is adjusted independently from a compressive stress adjustment of the remaining nip. It is noted that a sag compensation roll, such as, for example, a jacketed type sag compensation roll, may be used for at least one of the upper roll and the lower roll.

Additionally, the method may pass the material web through the first roll stack and a second roll stack, in which the second roll stack has a second upper roll, a second lower roll, and at least one intermediary roll, that are arranged to form a second upper nip between the second upper roll and the intermediary roll, so that a second remaining nip is formed between the second lower roll and the intermediary roll. The upper roll stack and the lower roll stack are arranged one after another in a direction of travel of the material web, such that a predetermined roll of the at least one intermediate roll of the first roll stack comes into contact with a first side of the material web, while a predetermined roll of the at least one intermediary roll of the second roll stack comes into contact with a second side of the material web.

BRIEF DESCRIPTION OF THE DRAWINGS

The foregoing and other objects, features, and advantages of the invention will be apparent from the following more particular description of a preferred embodiment, as illustrated in the accompanying drawings, in which reference characters refer to the same parts throughout the various views, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than necessary for the fundamental understanding of the present invention, the description taken with the drawings making apparent to those skilled in the art how the several forms of the present invention may be embodied in practice.

Figure 1:
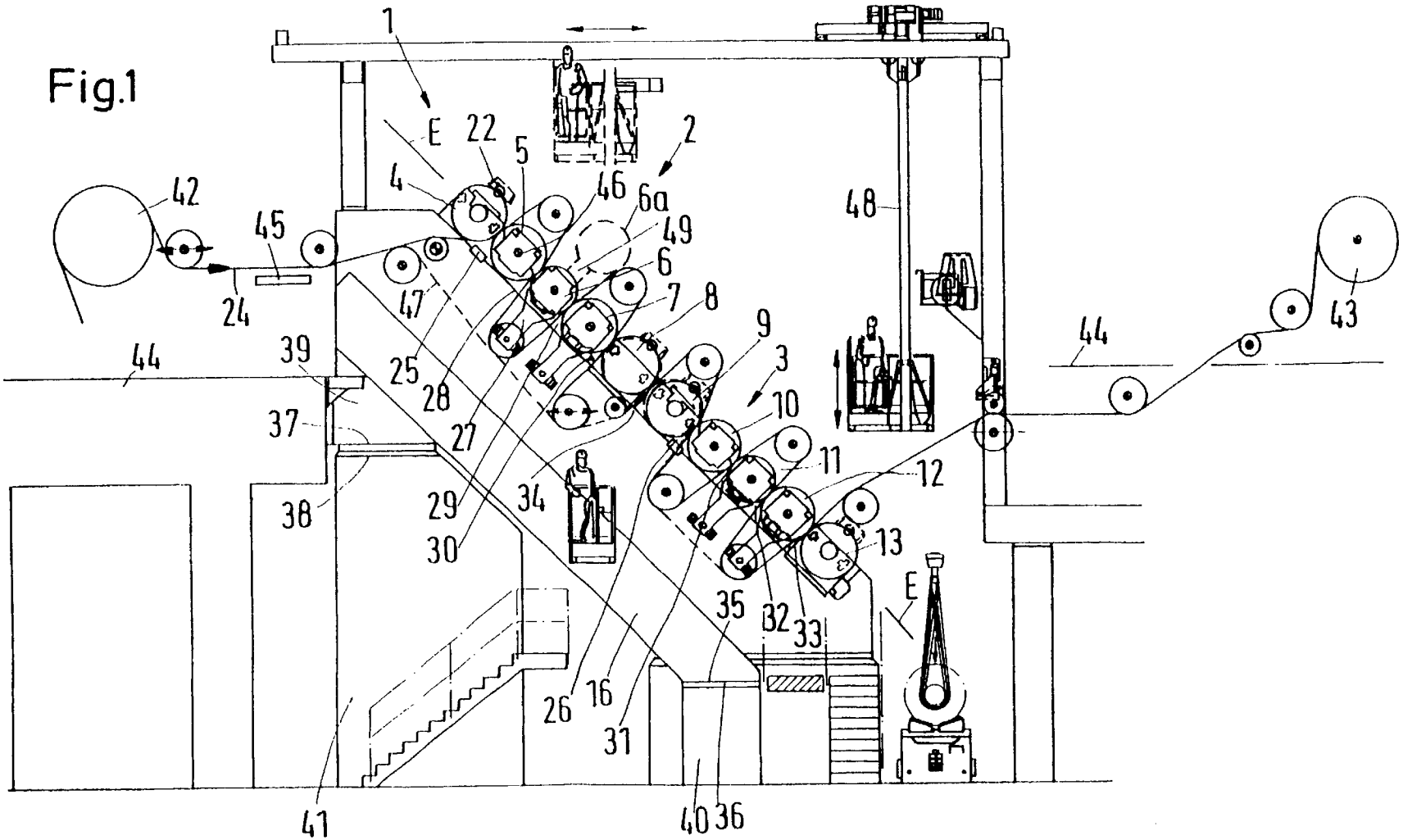
FIG. 1 illustrates a schematic side view of a calender according to a preferred embodiment of the present invention.

FIG. 1 illustrates a calender 1 that processes material webs, such as, for example, paper webs or cardboard webs. The calender 1 has an upper roll stack 2 and a lower roll stack 3.

In a preferred embodiment, the upper roll stack 2 has five rolls, and the lower roll stack 3 has five rolls. However, it is understood that differing number of rolls, such as, for example, eight rolls, may be provided without departing from the spirit and/or scope of the invention.

In the disclosed invention, the upper roll stack 2 comprises an upper roll 4, a plurality of intermediate rolls 5, 6 and 7, and a lower roll 8. The lower roll stack 3 comprises an upper roll 9, a plurality of intermediate rolls 10, 11 and 12, and a lower roll 13.

The upper rolls 4 and 9 and the lower rolls 8 and 13 comprise sag compensation rolls of the jacketed lift type. In the disclosed invention, each sag compensation roll has the same construction. One spare roll is provided for the four end rolls. However, it is understood that the sag compensation rolls can have differing structures without departing from the spirit and/or scope of the invention.

Figure 2:
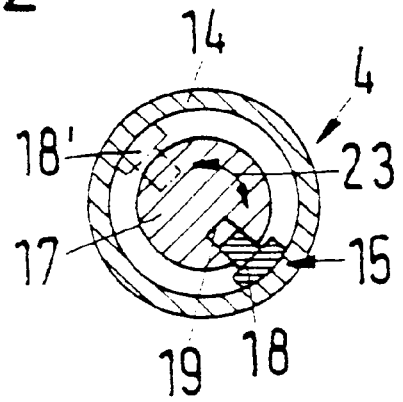
FIG. 2 illustrates a cross-section through a central region of a sag compensation roll of the calender of FIG. 1.
Figure 3:
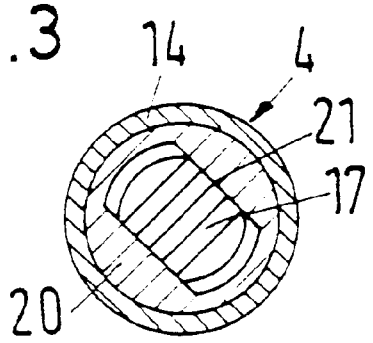
FIG. 3 illustrates a cross-section through an edge region of the sag compensation roll.

As shown in FIGS. 2 and 3, sag compensation roll 4 has a jacket 14 that is supported by a sag compensation device 15 associated with a bracket 17. The bracket 17 is non-rotatably fixed (secured) to a frame 16. In the present example, the sag compensation device 15 comprises a group of hydrostatic support elements 18 that are supplied, in a known fashion, via a pressure chamber 19, with a pressure medium, such as air, in such a way that the sag compensation device 15 also serves as a loading device.

The roll jacket 14 is mounted, at its ends, on a bearing ring 20 that is displaced in a lift direction on a lifting guide 21. As a result, the roll jacket 14 is movable in the lift direction over its entire length. It is noted that bracket 17, which supports the sag compensation rolls, may be displaced a predetermined amount, such as, for example, by approximately 180 degrees, by an adjustment device 22 (cf. arrow 23 in FIG. 2), such that the operational direction of the sag compensation device 15 points in the opposite direction. This is indicated in FIG. 2 by support element 18', which is depicted by dot-dash lines. However, it is understood that the displacement amount may differ from the approximate 180 degrees, discussed above, without departing from the spirit and/or scope of the invention.

In the present invention, the upper intermediate rolls 5 and 10 are fixedly mounted on the frame 16. When the sag compensation device 15 is in the position depicted in FIG. 2, the material web 24 (such as, for example, a paper web) is processed in a first nip 25 associated with upper roll stack 2 (and a first nip 26 associated with the lower roll stack 3) in the direction of travel of the upper roll stack 2 (or in the direction of travel of the lower roll stack 3) with a very high line load, and thus, with a high compressive stress.

Intermediate rolls 6, 7, 11 and 12 are each mounted on a respective lever 27. Each lever 27 pivots around a frame-fixed pivot axis (not labeled). When the sag compensation device 15 of the lower roll 8 (and the sag compensation device 15 of the lower roll 13) has the position depicted by hatch marks in FIG. 2, nips 28, 29 and 30 of the upper roll stack 2, and nips 31, 32 and 33 of the lower roll stack 3, are loaded. The magnitude of the load in nips 28, 29 and 30 (or nips 31, 32 and 33) is independent of the magnitude of the load in the respective first nip 25 (or nip 26). Consequently, four sections exist in which the paper web 24 can be processed differently, resulting in the production of many different paper qualities.

The construction of the present invention results in the formation of an open nip 34 between the lower roll 8 (of the upper roll stack 2) and the upper roll 9 (of the lower roll stack 3). During the operation of the calender, the paper web 24 passes unhindered through the open nip 34. As a result, one side of the paper web 24 is glazed by the upper roll stack 2, while the other side (second side) is glazed by the lower roll stack 3.

In the disclosed invention, upper and lower rolls 4, 8, 9 and 13, as well as central intermediate rolls 7 and 11 comprise elastic rolls, while remaining intermediate rolls 5, 7, 10 and 12 comprise heated hard rolls. However, other combinations are also possible without departing from the spirit and/or scope of the invention. For example, instead of using elastic upper and lower rolls, the upper and lower rolls may comprise hard upper and lower rolls.

In the present invention, a distance between sag compensation roll 9 and sag compensation roll 10 is small (e.g., approximately 30 to 40 mm), and the open nip 34 may be closed by, using, for example, a roll hub. This is accomplished, in the present invention, by rotating the sag compensation device 15 of the lower roll 8 (of the upper roll stack 2) and the sag compensation device 15 of the upper roll 9 (of the lower roll stack 3) toward each other using the adjustment device 22, and then adding an appropriate pressure to the medium.

In the present invention, the two sag compensation rolls 8 and 9 have an elastic coating. Thus, a material web passed through the open nip 34 will obtain a matt finish. As a result, the present invention provides multiple processing capabilities.

Figure 4:
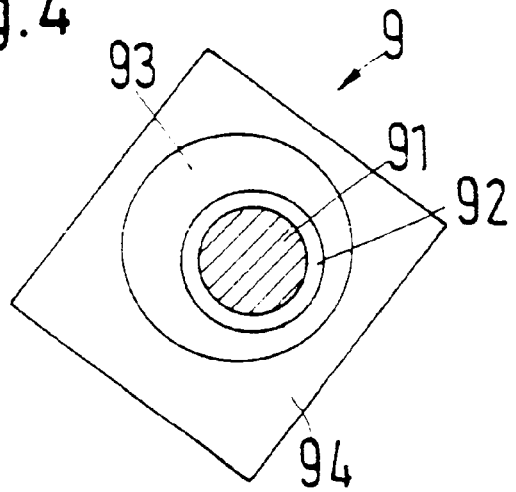
FIG. 4 illustrates a schematic depiction of a mounting of a bracket of the sag compensation roll.

If the open nip 34 is larger (e.g., greater than approximately 40 mm) and the jacket lift is unable to close the opening, bracket 91 of the upper roll 9 may be mounted in a spherical cap 92, which is in turn mounted on an eccentric disk 93, as shown in FIG. 4. The eccentric disk 93 is pivotable by approximately 180 degrees about bearing 94, together with the bracket 91, by the adjustment device 22. Thus, the open nip 34 can be held at an opening of, for example, approximately 80 mm.

In the disclosed invention, the axes of rolls 4 through 13 lie roughly in a common plane E (see FIG. 1), which is inclined approximately 45 degrees relative to a horizontal. Accordingly, frame 16 has an oblique path. Frame 16 is supported at two points. Specifically, frame 16 has a lower support surface 35 with a bearing surface 36 that is solidly attached to a structure, such as, for example, a building, and an upper bearing surface 37 with an upper bearing surface 38 that is also solidly attached to the structure (e.g., building). In the disclosed embodiment, the upper bearing surface 37 is located on a foot 39 installed on the frame 16 proximate its upper end. The bearing surfaces 36 and 38 run horizontally, and are each positioned on a concrete footing or base 40 and 41, respectively. Thus, the frame 16 is largely insensitive to vibrations. This also permits the frame 16 to be less expensively produced and with a lower stability, as compared to prior frames. However, it is understood that variations in the construction of the frame and its mounting may be made without departing from the spirit and/or scope of the instant invention.

The calender 1 is used in an online production operation. The calender 1 is located between, for example, a last drying roll 42 of a dry section of, for example, a paper machine, and, for example, a winder 43, such as, for example, a roll cutter and winder. In the disclosed embodiment, the drying roll 42 and the winder 43 are located at roughly the same height and above a working plane 44 (see FIG. 1), through which the calender 1 passes. Thus, the material web (e.g., paper web 24) has a relatively small rising path between the drying roll 42 and the entry of the calender 1, as well as between the outlet of the calender 1 and the winder 43. This facilitates the introduction of the paper web 24 into the calender 1 during the online production operation. The same advantage is obtained when the paper web is introduced from the drying roll 42 down into the calender 1 and exits upward to the winder 43. However, it is understood that the levelness of the calender 1 may be varied without departing from the scope and/or spirit of the invention.

A web feeding device 45 (see FIG. 1) is employed in the disclosed embodiment to guide the front end of the web through all the nips 25 through 33 of the two roll stacks 2 and 3, as well as the open nip 34. That is, the web feeding device 45 suffices for feeding the material web to both roll stacks. It is noted that all the rolls of the calender 1 and the respective guide rolls have their own respective drive 46. The paper processing operation thus depends on which of the nips, mentioned above, are closed. A second web feeding device 47 is employed in the present invention to supply a material web to only the open nip 34. The path of the material web fed to the open nip 34 by the second web feeding device 47 is illustrated in FIG. 1 by broken lines.

It is noted that the construction of the calender 1 permits repairs to be made to it, or for the rolls of the calender 1 to be exchanged, while the web is introduced (via the second web feeding device 47) to the open nip 34, which, as noted above, imparts a matt finish to the material web. It is further noted that a semi-matt finish may be applied to the material web when, for example, only the upper nip 25 is used.

The precise incline of the frame 16 of the present invention is dependent upon local conditions. Values that deviate by roughly 10 degrees more, or less than 45 degrees, from level fall within the preferred range.

The angular inclination of the roll stacks provides an additional advantage, in that the rolls are more readily accessible. For example, the rolls can be removed (and inserted) by an individual utilizing a crane 48 having an associated controller. In the present invention, the mounting of the roll to be exchanged can be pulled out with a hydraulic adjustment device 49 (see broken lines in FIG. 1) arranged along a guide perpendicular to the plane E. In the disclosed invention, the adjustment device 49 comprises a piston of a hydraulic cylinder that extends along lever 27. In the outer position, the crane 48 grasps the roll ends of a roll and removes the roll vertically.

It is noted that the foregoing example has been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and/or spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

I claim:

1. Calender for use with a material web, comprising:

a frame;

at least two roll stacks, each roll stack of said at least two roll stacks having a plurality of rolls, end rolls of said plurality of rolls forming sag compensation rolls with a jacket, said sag compensation rolls being supported on a bracket non-rotatably secured to said frame, an intermediate roll being positioned adjacent one of said sag compensation rolls, said intermediate roll being fixedly mounted to said frame; and an adjusting device that adjusts a sag compensation roll in order to adjust a compressive stress in a first nip, said compressive stress in said first nip being independently adjusted from a compressive stress adjustment of a second nip.

2. The calender of claim 1, wherein said end rolls comprise jacketed lift type rolls that are fixedly mounted to said frame by said bracket.

3. The calender of claim 1, wherein said intermediate roll is located below an upper intermediate roll that is attached to a pivotally mounted lever.

4. The calender of claim 1, wherein said at least two roll stacks are arranged one after another in a direction of travel of the material web, such that an intermediate roll of a first roll stack comes into contact with one side of the material web, while an immediate roll of a second roll stack comes into contact with another side of the material web.

5. The calender of claim 1, said sag compensation rolls comprising an upper sag compensation roll and a lower sag compensation roll for each of said at least two roll stacks;

wherein said intermediate roll comprises an uppermost intermediate roll which is positioned adjacent said upper sag compensation roll.

6. A calender for use with a material web, said calender having at least one roll stack with at least four rolls, in which end rolls of the at least one roll stack are designed as sag compensation rolls with a jacket non-rotatably supported on a bracket, said calender comprising:

an intermediate roll that is positioned proximate an upper sag compensation roll; and an adjusting device that adjusts a compressive stress in an upper nip independently of a compressive stress in a remaining nip.

7. The calender according to claim 6, wherein said intermediate roll is fixedly mounted to a frame of the calender.

8. A calender for use with a material web, comprising:

a roll stack, comprising:

an upper roll;

a lower roll; and at least one intermediate roll, an upper nip being formed between said upper roll and said intermediate roll, and a second nip being formed between said lower roll and said intermediate roll; and an adjusting device that adjusts a compressive stress in said first nip independently from a compressive stress adjustment of said second nip.

9. The calender of claim 8, wherein said at least one intermediate roll comprises a plurality of intermediate rolls, additional nips being formed by said plurality of intermediate rolls, said compressive stress in said upper nip being adjusted independently from a compressive stress adjustment of said additional nips.

10. The calender of claim 9, wherein said compressive stress in said upper nip is adjusted independently from a compressive stress adjustment of said lower nip and said additional nips.

11. The calender of claim 8, wherein at least one of said upper roll and said lower roll comprises a sag compensation roll.

12. The calender of claim 11, wherein said sag compensation roll is of the jacketed lift type.

13. The calender of claim 8, further comprising:

a frame; and a mounting device that fixedly mounts said intermediate roll to said frame.

14. The calender of claim 8, further comprising:

a frame; and a lever that pivotally mounts said intermediate roll about a frame-fixed pivot axis.

15. The calender of claim 8, wherein said upper roll comprises an elastic upper roll, and said lower roll comprises an elastic lower roll.

16. The calender of claim 15, wherein said intermediate roll comprises a heated hard roll.

17. The calender of claim 8, wherein said upper roll comprises a hard upper roll, and said lower roll comprises a halower roll.

18. The calender of claim 17, wherein said intermediate roll comprises a heated hard roll.

19. The calender of claim 8, said at least one intermediate roll comprising a plurality of intermediate rolls, including an uppermost intermediate roll which is positioned adjacent said upper roll;

wherein said uppermost intermediate roll is fixed to a frame of said calender.

20. A calender for use with a material web, comprising:

an upper roll stack, comprising:

an upper roll;

a lower roll; and a plurality of intermediate rolls, a first upper nip being formed between said upper roll of said upper roll stack and one intermediate roll of said plurality of intermediate rolls of said upper roll stack, remaining nips being formed between said plurality of intermediate rolls and between one intermediate roll and said lower roll of said upper roll stack;

a lower roll stack, comprising:

an upper roll;

a lower roll; and a plurality of intermediate rolls, a second upper nip being formed between said upper roll of said lower roll stack and one intermediate roll of said plurality of intermediate rolls of said lower roll stack, remaining nips being formed between said plurality of intermediate rolls and between an intermediate roll and said lower roll of said lower roll stack; and an adjusting device that adjusts a magnitude of a load in at least one of said first upper nip and said second upper nip independently of a magnitude of another load in said remaining nips of said at least one of said upper roll stack and said lower roll stack.

21. The calender of claim 20, wherein an open nip is formed between said lower roll of said upper roll stack and said upper roll of said lower roll stack.

22. The calender of claim 21, wherein a distance of said open nip is adjustable.

23. The calender of claim 20, wherein said upper roll stack and said lower roll stack are arranged one after another in a direction of travel of the material web, such that a predetermined roll of said plurality of intermediate rolls of said first roll stack comes into contact with a first side of the material web, while a predetermined roll of said plurality of intermediate rolls of said second roll stack comes into contact with a second side of the material web.

24. The calender according to claim 20, wherein said one intermediate rolls, which form said first and second upper nips, are fixed to a frame of said calender.

25. A method for processing a material web, comprising:

passing the material web through a first roll stack having an upper roll, a lower roll and at least one intermediate roll that are arranged to form an upper nip between the upper roll and the intermediate roll and a remaining nip between the lower roll and the intermediate roll; and adjusting a compressive stress in the first nip independently from a compressive stress adjustment of the remaining nip.

26. The method of claim 25, further comprising using a sag compensation roll for at least one of the upper roll and the lower roll.

27. The method of claim 26, further comprising using at least one jacketed lift type sag compensation roll.

28. The method of claim 25, further comprising:

passing the material web through the first roll stack and a second roll stack, the second roll stack having a second upper roll, a second lower roll, and at least one intermediary roll, that are arranged to form a second upper nip between the second upper roll and the intermediary roll, a second remaining nip being formed between the second lower roll and the intermediary roll; and arranging the upper roll stack and the lower roll stack one after another in a direction of travel of the material web, such that a predetermined roll of the at least one intermediate roll of the first roll stack comes into contact with a first side of the material web, while a predetermined roll of the at least one intermediary roll of the second roll stack comes into contact with a second side of the material web.

29. The method according to claim 25, wherein the intermediate roll, which forms the upper nip with the upper roll, is fixed to a frame of the calender.

* * * * *